United States Patent [19]

Mandich

[11] 4,055,363

[45] Oct. 25, 1977

[54] SANITARY DEVICE FOR PICKING UP ANIMAL DROPPINGS

[76] Inventor: Pete Mandich, 1103 Sheffield Ave., Alliquipa, Pa. 15001

[21] Appl. No.: 772,772

[22] Filed: Feb. 28, 1977

[51] Int. Cl.[2] ..... A01K 29/00

[52] U.S. Cl. ..... 294/19 R; 294/1 R

[58] Field of Search ..... 294/1 R, 19 R, 19 A, 294/55, 50.6, 50.8; 15/104.8, 257.1, 257.6; 56/327 R, 328 R, 332, 333

[56] References Cited

U.S. PATENT DOCUMENTS

| | | | |
|---|---|---|---|
| 3,446,525 | 5/1969 | Jones | 294/19 R |
| 3,716,263 | 2/1973 | Gatti | 294/1 R X |
| 3,738,697 | 6/1973 | Kahan | 294/19 R |
| 3,767,247 | 10/1973 | Wetzler | 294/1 R |
| 3,912,316 | 10/1975 | Veech | 294/19 R |

*Primary Examiner*—Johnny D. Cherry
*Attorney, Agent, or Firm*—John H. Perkins

[57] ABSTRACT

A portable device for picking up animal droppings and other such items. The person using the device does not have to bend over to pick the items up and their hands need not come into contact with the items being picked up. The device makes use of a disposable bag that encloses the object being picked up and both the bag and the object can be thrown out.

5 Claims, 4 Drawing Figures

SANITARY DEVICE FOR PICKING UP ANIMAL DROPPINGS

BACKGROUND OF THE INVENTION

With the continuing growth and crowding of our communities, the problem of collecting and disposing of waste materials left by pets has been increasing. In recent years some of our cities have passed legislation concerning the responsibility of the pet owners in this regard. It is the purpose of this invention to provide a simple, sanitary and effective means of dealing with this problem. Prior inventions have been developed with the same purpose, but none have provided the simplicities of operation. This invention is more efficient in that it scrapes the area where the waste is deposited. It is more efficient in that it uses a relatively small bag which can be easily replaced.

SUMMARY OF THE INVENTION

The present invention consists basically of two angular operating rods with elongated folded strips attached at their lower end. The said folded elongated strips are used to hold a small bag in an inverted position. The two angular operating rods are pivotally connected to two U-shaped operating rods. By applying pressure to one end of the said U-shaped operating rods, the said elongated folded strips are made to move copperatively toward each other until contact is made and the attached bag is closed.

On the bag that is used with this device, there are two strips attached about the edge of the open end. These strips are of equal length and are oppositely positioned on the mouth of the bag. The strips are also attached so that a portion of the strips extends toward the inside of the bag and a portion extends to the outside of the bag. The portions of the strips extending to the outside of the bag are designed to be inserted into the folds of the elongated folded strips which is the manner in which the bag is held by the device. When placed in the elongated folded strips the strips attached to the bag are held such that the sections of the strips on the inside edges of the bag are pointed in a slightly downward position. When the device is operated and the bag is caused to close, the section of the attached strips that extend toward the inside of the bag will scrape along the surface in a shovel-like motion picking up objects in its path and causing the object to be enclosed by the bag when the mouth of the bag is closed.

The U-shaped operating rods are mounted such that when the device is to be used, the U is inverted. They are also mounted so that the rods form mirror images of each other. The section of the operating rods that form the legs of the "U" are not of equal length. The two legs that are farthest apart are the longest and are of equal length and the two that are the closest are of equal length and are about $\frac{1}{3}$ the length of the longer legs. At a point on the legs very close to the bend which forms the "U" shape the operating rod passes through a frame which can be of any shape or material that will hold the operating rods in position and still permit the necessary freedom of motion for the rods to perform their described function.

A handle is attached to the frame so that the device can be held and operated with no bending necessary on the part of the person using the device.

To use the device it is positioned so that the U-shaped operating rods are in an inverted position with the longer legs of the "U" being in contact with the surface on which the object to be picked is laying. The object to be picked up is positioned midway between the folded elongated strips and is covered by the inverted bag. The folded elongated strips are at their maximum separation and would be slightly above the surface. The edge of the inner section of those strips attached to the bag are in contact with the surface. As pressure is applied to the handle in a downward direction, this creates an upward force against the legs of the U-shaped operating rods resting on the surface. The pressure on the U-shaped operating rods is transmitted to the angular operating rods which are pivotally connected to posts extending from the frame. The pressure causes the angular operating rods to pivot such that the folded elongated strips are moved cooperatively toward each other causing the attached bag to close while the strips attached to the mouth of the bag scrape the surface and enclose any item resting on the surface in the bag. When the pressure is released, the bag will remain closed and the folded elongated strips will remain in contact until manually separated. This is accomplished by designing the frame such that the U-shaped operating rods become wedged in the frame with the application of the pressure as herein described. The U-shaped rods become unwedged and the device opened with only a slight amount of pressure applied in the opposite direction. While the device is still closed the bag can be removed by sliding the strips attached to the bag out of the open ends of the elongated folded strips.

DESCRIPTION OF THE PREFERRED EMBODIMENTS

Figure 1:
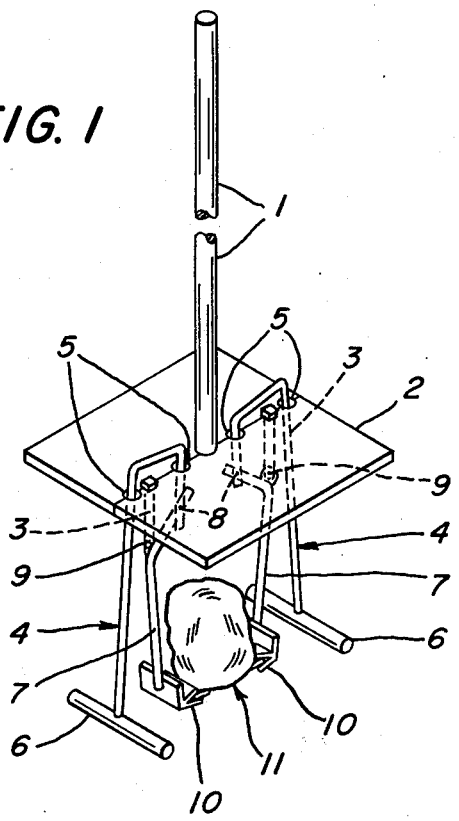
FIG. 1 is a perspective view of the device in accordance with the present invention.

Turning now to the drawings, in FIG. 1 there is shown a presently preferred embodiment in accordance with the present invention concepts. A pair of elongated folded strips 10 are secured to the lower end of a pair of angular operating rods 7. The said angular operating rods are pivotally connected at a point 9 near their bend to posts 3 which posts are in turn rigidly connected at their opposite end to a frame 2. The top end of the said angular operating rods are pivotally connected at point 8 to U-shaped operating rods 4. The said U-shaped operating rod is designed to have one leg shorter than the other with the shorter leg being about one third the length of the longer leg. The shorter leg of the U-shaped operating rod as can be seen in FIG. 1 is attached to the angular operating rod and the U-shaped operating rods are mounted so as to form mirror images of each other. The U-shaped operating rods pass through holes 5 in the frame 2. When the device is operated support rods 6, rigidly mounted at the lower ends of the said U-shaped operating rods are in contact with a surface. As a downward pressure is applied through the handle 1 of the device a resultant and opposite pressure is transmitted to the said support rods which in turn transmits a lifting force to the connections 8. As this said lifting force is continued to be applied to the top end of the angular operating rods, the said angular operating rods are caused to pivot about connection 9. This pivotal motion then causes the said elongated folded strips 10 to move toward each other making the mouth of the bag 11 close.

Figure 2:
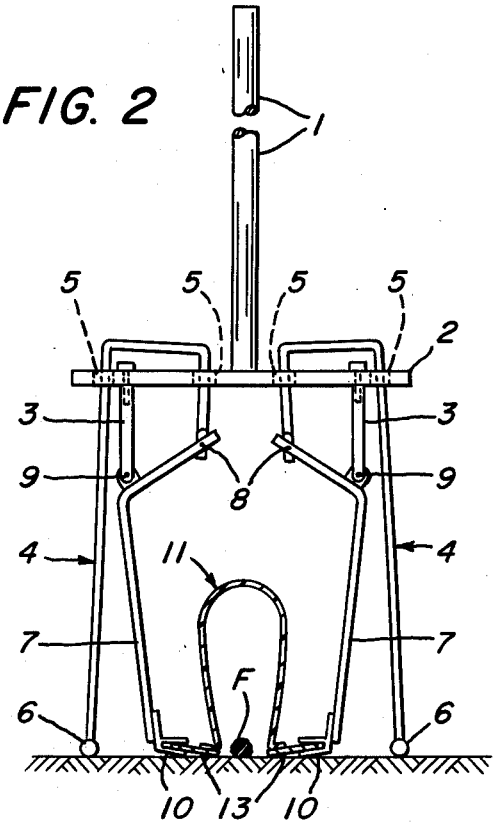
FIG. 2 is a side view of the device showing the device in an open position ready to pick up an object.

Looking now at FIG. 2 it can be seen that the bag 11 is made of a flexible material of sufficient structural strength for the said bag to be self-supporting when placed in an inverted position. F represents an animal feces or any other object intended to be picked up by the device. Attached along their length to the open mouth of the bag are two strips 13. These strips are attached to the bag such that a section of the strips extends toward the mouth of the bag. The opposite sides of the strips extend beyond the edge of the bag a sufficient distance to be inserted into the fold of the elongated folded strips. The section of the strips that are placed into the fold of the elongated folded strips should fit snugly into the said fold so that they do not slide without the application of some force. The strips attached to the bag should be slightly longer in length than the elongated folded strips. This is so that a used bag can be easily removed by holding the edge of the strips extending beyond the edge of the elongated folded strips and sliding the strips and the attached bag out. It should be noted in looking at FIG. 2 that the said strips 13 are held in the elongated folded strips in such a way that the inner edge of the strips are pointed in a slightly downward position.

Figure 3:
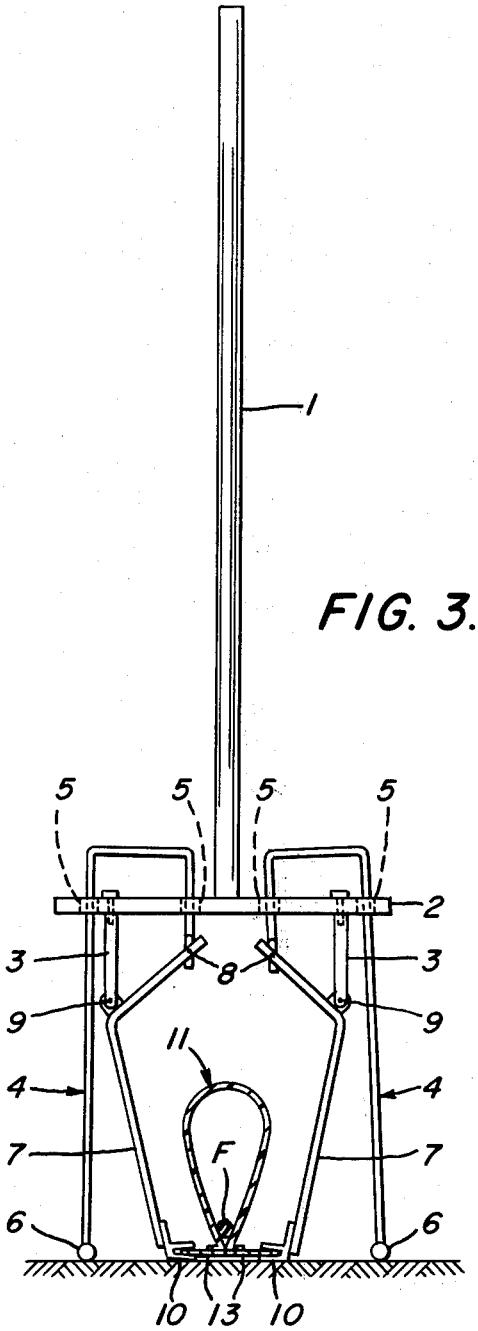
FIG. 3 is a side view of the device showing the device in a closed position.

Turning now to FIG. 3 the device is shown in a closed position with the feces F being enclosed in the bag. It should be noted that the strips attached to the bag have moved in a shovel-type manner to pick up the said feces and enclosed it in the bag. In a closed position the said strips are now parallel to the surface and the inner edges of the strips are now overlapping.

Figure 4:
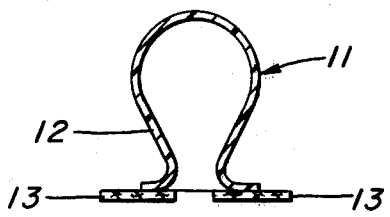
FIG. 4 is a side and cut away view of the bag used in connection with this device.

In FIG. 4, shown is a cross-sectional view of the bag wherein the only opening in the bag is through the bottom between the strips and a cut away cross-section 12 of the bag is shown.

I claim:

1. A portable device for picking up objects without having ones' hands come into contact with the said object comprising:

a. A first assemblage including a first folded elongated strip projecting angularly from and secured to the lower end of a first angular operating rod, which operating rod is pivotally connected at its bend to a frame and pivotally connected at its opposite end to a second operating rod which second operating rod is an inverted U-shape having its lower end extended to a point in an approximate plane with the said elongated strip.

b. A second assemblage including a second folded elongated strip projecting angularly from and secured to the lower end of a third angular operating rod which operating rod is pivotally connected at its bend to a frame and pivotally connected at its opposite end to a fourth operating rod, which fourth operating rod is an inverted U-shape having its lower end extended to a point in an approximate plane with the said elongated strips.

c. A third assemblage including a frame in which the said first and third operating rods are connected for holding the said rods in such a position to allow the said folded elongated strips to move towards each other and away from each other with the manipulation of the operating rods.

d. A bag having a first blade-like member attached to its open end which first blade-like member is detachably attached to the first elongated strip and a second blade-like member attached to its open end which second blade-like member is detachably attached to the second elongated strip so that the inverted bag is selectively opened and closed by the movements of the folded elongated strips resulting from the manipulation of the said operating rods.

2. A device as defined in claim 1, wherein said bag is of limp material and wherein the blade-like member of the bags open end are secured along the substantial entirety of the said first and second folded elongated strips.

3. A device as defined in claim 2, wherein said folded elongated strips are secured to the first and third operating rods on the exterior portion of the fold and near the center of the strip.

4. A device as defined in claim 3 having a handle extending upwardly from the said frame.

5. A device as defined in claim 1, wherein the said folded elongated strips are held in a separated position keeping the bag open until closed by manipulation of the said operating rods.

* * * * *